United States Patent [19]

Dessilani

[11] Patent Number: 4,458,626

[45] Date of Patent: Jul. 10, 1984

[54] MACHINE FOR SPRAY PAINTING A MATERIAL BEING CARRIED ON A BLANKET

[76] Inventor: Teresio Dessilani, Viale Fassó24 - Borgosesia, (Vercelli), Italy

[21] Appl. No.: 438,134

[22] Filed: Nov. 1, 1982

[30] Foreign Application Priority Data

Nov. 9, 1981 [IT] Italy ..... 24909 A/81

[51] Int. Cl.[3] ..... B05B 1/14; B05B 1/26

[52] U.S. Cl. ..... 118/315; 118/314; 118/323; 118/324; 118/326

[58] Field of Search ..... 427/424, 421; 118/315, 118/323, 324, 326, 314; 239/290, 292, 296, 300, 239/412

[56] References Cited

U.S. PATENT DOCUMENTS 3,050,416 8/1962 Yahnke ..... 118/324

3,185,129 5/1965 Sollich ..... 118/315

4,132,357 1/1979 Blackinton ..... 239/290 X 4,267,795 5/1981 Reba ..... 118/315

*Primary Examiner*—Shrive P. Beck

*Attorney, Agent, or Firm*—Guido Modiano; Albert Josif

[57] ABSTRACT

This machine for spray painting hides, cardboard, and the like, while being carried on a moving blanket, comprises spray guns mounted in-line transversely to the blanket and adjustable simultaneously, as well as being easily installed and interchangeable. For a uniform distribution of the paint being sprayed, the spray gun jets are swept by jets or sheets of air issued from nozzles reciprocating with at least one component transverse to the blanket direction of movement. Moreover, the machine is equipped, in the proximities of the spray line, with nozzles for generating air sheets which have the function of trapping onto the workpiece the fumes rebounding from the spraying process.

10 Claims, 5 Drawing Figures

MACHINE FOR SPRAY PAINTING A MATERIAL BEING CARRIED ON A BLANKET

BACKGROUND OF THE INVENTION

This invention relates to a machine for spray painting a material being carried on a blanket.

As a rule, spray painting of hides, cardboard, plywood, etc. while being transported on blankets, is effected by means of spray guns carried by a holder and moved transversely to the blanket with either a circular or reciprocating motion, so as to span the whole width of the workpiece to be sprayed. The mechanisms required for these movements involve high costs and space requirements. Moreover, in their fast movement, the spray guns set into motion the spraying fumes from the guns themselves, in addition to those rebounding from the swept workpiece, thus wasting large amounts of pigment or paint.

To obviate these drawbacks it would appear convenient to arrange the spray guns in a fixed position along a line extending tranverse to the machine. In this case, however, a uniform paint application would not be provided, because the spray guns would leave on the workpiece more densely painted stripes at the areas underlying the spray guns.

SUMMARY OF THE INVENTION

It is a primary object of this invention to overcome the deficiencies and limitations of the cited conventional spray painting machines by providing such a machine which is compact in size and relatively inexpensive, with an in-line arrangement of the spray guns, and at the same time capable of producing a uniform distribution of the pigment or paint over a workpiece to be painted.

It is another object of this invention to provide a machine which allows simultaneous adjustment of all the spray guns with simple means, and affords an easily carried out replacement of the spray guns.

These and other objects, such as will be apparent from the description which follows, are achieved by a machine for spray painting a material being carried on a blanket, comprising a plurality of spray guns arranged above said blanket, and characterized in that said spray guns are arranged fixedly and along a line extending transversely to the blanket direction of movement, that there is provided a plurality of nozzles associated with said spray guns for sending jets of fluid or air against the area being spray painted, and in that said nozzles, whose direction has a major component in the spraying direction of the spray guns, are mounted on a structure reciprocable with at least one component transverse to the direction of movement of said blanket, thereby making the issuing sprays more uniform and broader.

BRIEF DESCRIPTION OF THE DRAWINGS

Further features and advantages of the invention will be apparent from the following description of a preferred but not limitative embodiment thereof, given herein by way of example and illustrated in the accompanying drawings, where.

DESCRIPTION OF A PREFERRED EMBODIMENT

Figure 3:
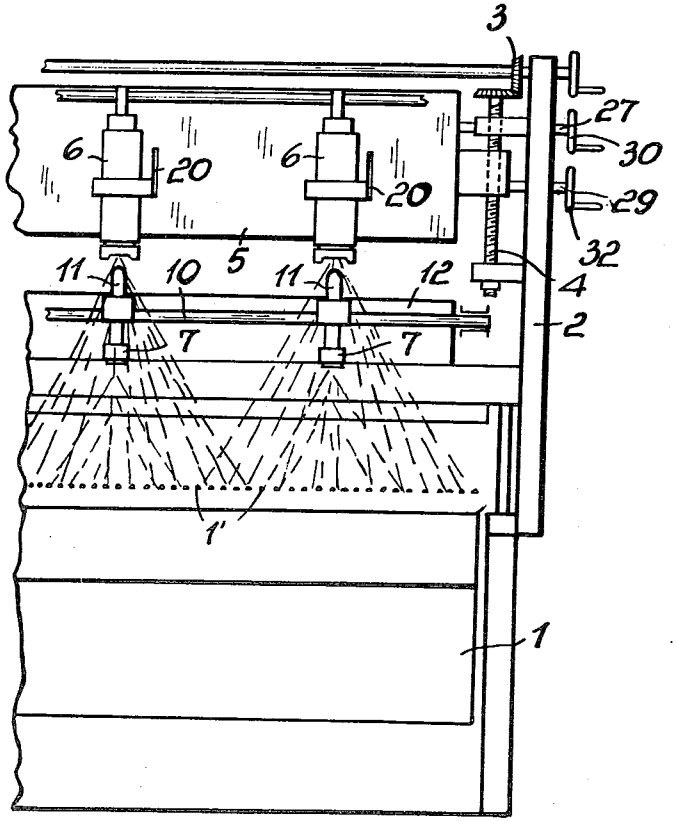
FIG. 3 is a fragmentary view of the machine taken in the direction of movement of the workpiece.

The machine illustrated in the drawings comprises a framework 1 which carries on either of its lateral sides a respective support 2, at the top whereof are mounted a pair of bevel gears 3 driving a threaded vertical rod 4 which carries a respective end of a box-like cross-piece 5. The rotation of the threaded bars 4 results, therefore, in the cross-piece 5 being raised or lowered. Along the whole length of the crosspiece 5, there are arranged at regular distances apart spray guns 6 of the automatic opening type, more clearly described hereinafter and directed vertically, while a blanket 1' runs below them in a perpendicular, i.e. transverse, direction to the crosspiece 5 major dimension.

Figure 1:
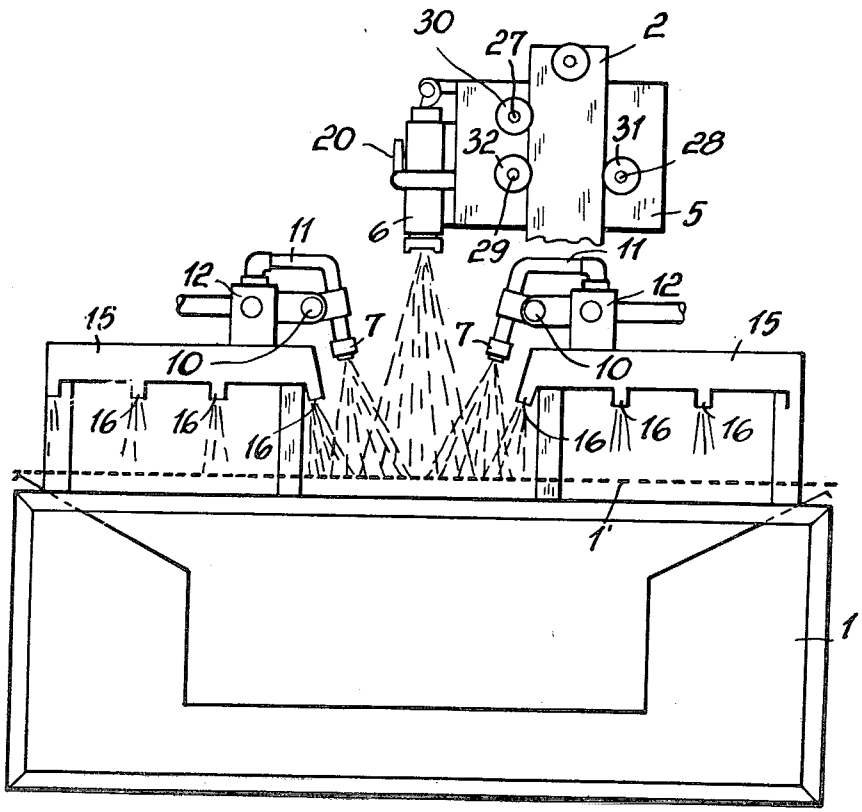
FIG. 1 is a schematical view of a machine according to the invention, taken in a perpendicular direction to the direction of movement of the workpiece.
Figure 2:
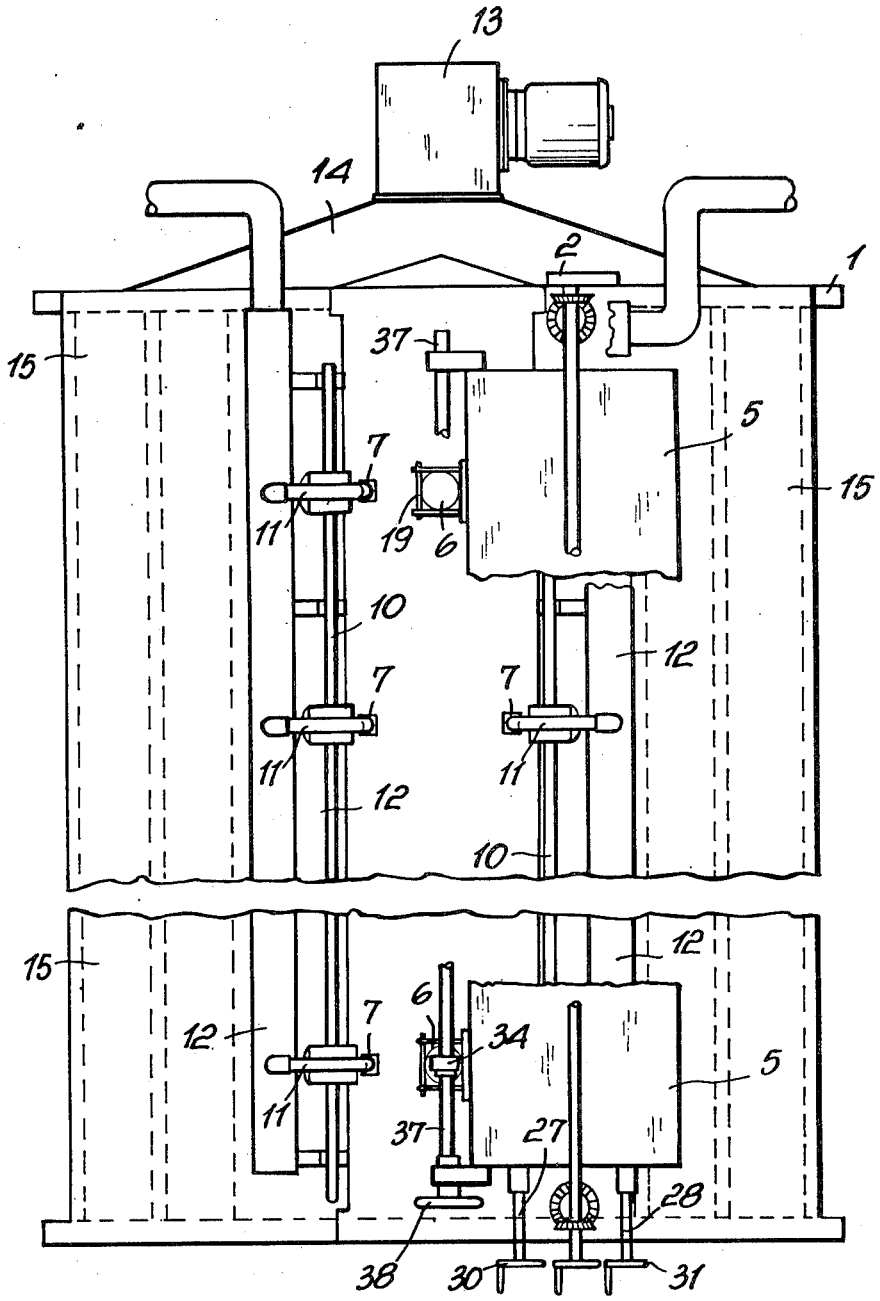
FIG. 2 is a plan view of the machine of FIG. 1.

Provided at each gun 6, oppositely and mutually converging and preferably located at an intermediate height between the guns 6 and blanket 1', are two nozzles 7 for blowing air or any other suitable fluid, which are supported for a reciprocating movement, so that the air jets issuing therefrom can intersect, spread wide and smooth out the distribution of the pigment or paint being sprayed from the spray guns 6. As shown in FIG. 1, the air jets from the nozzles 7 have a direction whose major component extends in the spraying direction of the guns 6.

Figure 4:
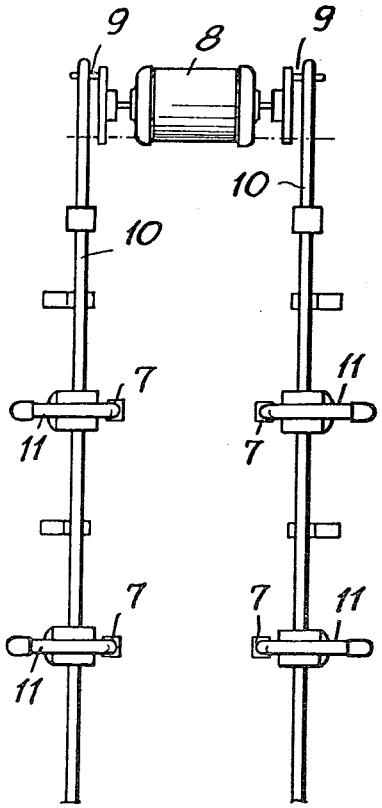
FIG. 4 is a schematical plan view of the drive mechanism for the air jet issuing nozzles.

FIG. 4 shows an example of a support or holder and translatory arrangement of the nozzles 7, wherein a motor 8 drives, through connecting rod and crank mechanism 9, preferably with adjustable stroke length, shafts 10 extending parallel to the cross-piece 5 and having the nozzles 7 attached thereto. The nozzles 7 of each bank or series are connected, through flexible hoses 11, to a fixed manifold 12 which is fed with pressurized air and extends parallel to the cross-piece 5. The speed imparted to the nozzles 7 may be changed to meet individual requirements.

A motor-driven fan assembly 13, through a duct 14, feeds two boxes 15 which extend through the entire width of the machine and are provided with slots 16 in their bottom portions. From these slots 16, air sheets are ejected which are effective to trap the fumes rebounding from the spray painting process. The top portion of the boxes 15 advantageously functions as a walking platform for replacing the spray guns 6 and adjusting the jets from the nozzles 7.

Figure 5:
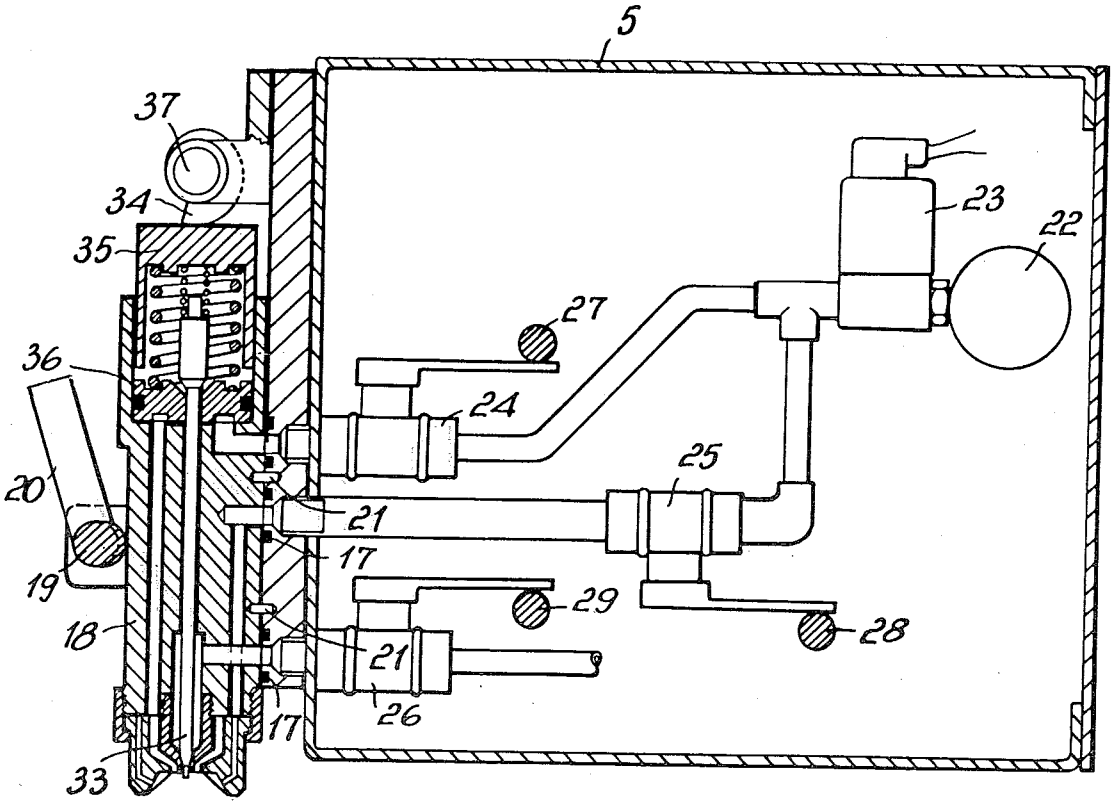
FIG. 5 is a sectional view taken through a spray gun and respective holder in a vertical plane lying parallel to the direction of movement of the workpiece.

The spray guns 6 (FIG. 5) are preferably of the type with automatically controlled opening and quick-connect design, as explained hereinafter. There adjustment features, instead of being individually provided for each gun, are led to the various connection points on the box-like crosspiece 5 such that all the guns can be adjusted simultaneously and to the same extent.

At each air and pigment intake hole, in the crosspiece 5, a ring seal 17 is provided for sealing purposes, it being pressed by the body 18 of the gun. Said body is urged against the crosspiece 5 through an eccentric pin 19 and actuating lever 20 system. The lever 20 is pivotable in lugs attached to the crosspiece 5 laterally to each gun 6. Two locating pins 21 ensure that the respective air and pigment intake holes of each gun 6 align with those formed in the crosspiece 5. Thus, quick installation or replacement of the guns 6 is accomplished.

The spraying air, from a header pipe 22 accommodated in the crosspiece 5, flows through a solenoid valve 23 (controlled by electronic detector systems) and intake conduit, to a valve 24 having a control lever. Downstream of the solenoid valve 23, another intake conduit or air pipe is passed through a valve 25 provided for adjusting the spray pattern in a manner known per se. A valve 26 is operative to shut off the admission of pigment through the respective intake conduit. The actuating levers for this set of valves, 24,25,26, cooperate respectively with rods 27,28,29, which extend parallel in the interior of the crosspiece 5 and are threaded at their end portions, where they are connected to respective handwheels 30,31,32, which by axially shifting the respective rods 27,28 and 29, adjust the extent of the valves 24,25,26 opening.

On the inside of each spray gun 6, a small rod 33 is provided for adjusting the gun span and, accordingly, the amount of pigment being sprayed. The rod 33 is driven upwards by a piston 36 movable within a chamber defined in the top portion of the gun 6 and subjected to the pressure of the air conveyed through the valve 24. The piston abuts against the bottom edge of a small adjusting cylinder 35 which is biased elastically upwards. The position of the cylinder 35 is defined by a spiralling profile cam 34, which is attached to a rod 37 also having attached thereto the corresponding cams associated with the other guns 6. By turning the rod 37 through a handwheel 38, it becomes possible to adjust the upward stroke length of the piston 36 and hence of the rod 33, that is the pigment outflow span, simultaneously for all the spray guns 6.

Advantageously, the movement of the nozzles 7 affords a uniform distribution of the pigment over the workpiece, since the direction of the air jets from the nozzles 7 results in the pigment jets being widened and moved progressively, thus preventing it from concentrating about the axes of the spray guns, which would produce more densely colored stripes on the workpiece, such as would be found in conventional machines if they would be equipped with fixedly arranged spray guns. It will be appreciated that the movement of the nozzles 7 can be accomplished with a lesser constructional complexity and investment than in the case of the guns of conventional moving spray gun machines. It has been found that an accurate orientation of the nozzles 7 affords surprisingly good spray painting results.

The invention provides, therefore, a machine of special effectiveness, by utilizing that very arrangement of the spray guns which, in current practice, would appear to be totally unsuitable for the achievement of satisfactory results.

The arrangement of pairs of nozzles 7 along concurrent directions allows the uniformity of the spray paint application to be improved, while the opposing action of the air jets increases the action of the pigment jet in a transverse direction to the direction of movement of the blanket 1' and reduces it in the direction of movement of the blanket, thus contributing to a more uniform spraying action in the workpiece cross direction.

The double set of nozzles 7 and slots 16 also permit, of course, the blanket 1' to be moved in either directions, for the same result.

It will be understood that the nozzles 7 of a same set could also be moved offset with respect to the nozzles 7 of the other nozzle set.

A mechanism for driving the nozzles 7 has been described which involves a purely transverse movement of the nozzles with respect to the workpiece. It will be appreciated, however, that the movement of the nozzles 7 may also be more complex, a movement having one component in the direction of motion of the workpiece being, for example, feasible which overlaps with the transverse movement. The outlet ends of the nozzles 7 could, in other words, be moved along circular or elliptical paths, in accordance with laws meeting the requirements of the type of workpiece and/or type of pigment or paint being sprayed. In practice, the nozzles 7 would be supported for oscillation about a perpendicular axis to the nozzle direction such as the axis of the corresponding shaft 10. The accomplishment of said movements is in practice well within the capabilities of a skilled person in the art, and will be no further discussed.

The invention described hereinabove may be, of course, largely modified without departing from its scope. Thus, as an example, the breadth of movement of the nozzles 7 could be other than that schematically illustrated herein. Similarly, a single set of in-line nozzles 7 could be provided, and/or a single box 15 with slots 16. It will be appreciated that the spray guns 6 could be of a different type from that shown, in particular, of a conventional type. The motor 8 could be of the controllable speed type, so as to provide various speeds for the set of nozzles 7, depending on individual requirements.

I claim:

1. A machine for spray painting a material being carried on a blanket, comprising a plurality of spray guns arranged above said blanket characterized in that said spray guns are arranged fixedly along a line extending transversely to the blanket direction of movement, that there is provided a plurality of nozzles associated with said spray guns for sending jets of fluid or air against the area being spray painted, and in that said nozzles, whose direction has a major component in the spraying direction of the spray guns, are mounted on a structure reciprocable with at least one component transverse to the direction of movement of said blanket, thereby making the issuing sprays more uniform and broader.

2. A machine according to claim 1, characterized in that said nozzles are mounted on a bar movable transversely to the direction of movement of said blanket and driven through a connecting rod and crank mechanism by a motor of the variable speed type.

3. A machine according to claim 1, characterized in that it comprises two sets of nozzles arranged in converging directions.

4. A machine according to claim 1, characterized in that said nozzles are supported for a pivotal movement about a perpendicular axis to the direction of said nozzles.

5. A machine according to claim 1, characterized in that said nozzles have an outlet port located substantially at an intermediate height level between said spray guns and said blanket.

6. A machine according to claim 1, characterized in that it comprises at least one box provided with slots for blowing air through the whole width of the machine at least downstream of said nozzles and trap onto the workpiece the fumes rebounding from the spray jets.

7. A machine according to claim 1, characterized in that said spray guns are arranged on a box-like crosspiece with height adjustment features.

8. A machine according to claim 1, characterized in that said box-like crosspiece is provided, for each said spray guns, with pigment or paint and air intake conduits, and that said spray guns are sealingly attachable to said box-like crosspiece, the conduits of said spray guns being aligned with said intake conduits by means of locating pins and notches, a lever and cam system being provided for locking said spray guns in place.

9. A machine according to either claim 8, characterized in that said box-like crosspiece is further provided, for each said spray guns, with a pressurized air supply conduit to produce the displacement of a piston engageable with a rod for adjusting the amount of pigment or paint being delivered, the travel limit of said piston being adjustable by means of a spiralling profile cam, the cams of all said spray guns being made rigid with a common rod for the simultaneous adjustment of all said spray guns.

10. A machine according to claim 8, characterized in that said intake conduits have respective adjustment and opening valves associated in said box-like crosspiece, the corresponding valves of all said spray guns being simultaneously controllable to equal extents.

* * * * *